US005813932A

United States Patent [19]

Grafton

[11] Patent Number: 5,813,932

[45] Date of Patent: Sep. 29, 1998

[54] GAME FOOTBAG HAVING IMPROVED SKIN AND FILLER

[76] Inventor: Charles E. Grafton, 1612 Fair Oaks Avenue, S. Pasadena, Calif. 91030

[21] Appl. No.: 914,549

[22] Filed: Aug. 19, 1997

[51] Int. Cl.[6] ..... A63B 37/02

[52] U.S. Cl. ..... 473/594; 473/607

[58] Field of Search ..... 473/569, 570, 473/572, 573, 577, 594, 595, 598, 600, 601, 602, 607, 608; D21/204, 205

[56] References Cited

U.S. PATENT DOCUMENTS

| | | | |
|---|---|---|---|
| D. 281,521 | 11/1985 | Stalberger, Jr et al. | D21/205 |
| D. 292,014 | 9/1987 | Stalberger, Jr et al. | D21/205 |
| 1,960,803 | 5/1934 | Baumer | 473/598 |
| 2,284,265 | 2/1942 | Hurt | 473/600 |
| 3,937,470 | 2/1976 | Stalberger, Jr. et al | 473/598 |
| 4,011,611 | 3/1977 | Lederman | 473/594 |
| 4,151,994 | 5/1979 | Stalberger, Jr. | 473/594 |
| 4,354,679 | 10/1982 | Steinmetz | 473/594 |
| 4,717,158 | 1/1988 | Pennisi | 473/570 |
| 4,943,066 | 7/1990 | Lathim et al. | 473/594 |
| 4,963,117 | 10/1990 | Gualdoni . | |
| 4,974,844 | 12/1990 | Richards | 473/607 |
| 5,066,018 | 11/1991 | Hinton | 473/594 |
| 5,328,191 | 7/1994 | Taylor, Jr. | 473/470 |
| 5,429,351 | 7/1995 | Hanson | 473/594 |
| 5,566,953 | 10/1996 | Arriola et al. | 473/594 |
| 5,603,497 | 2/1997 | Louez | 473/609 |

*Primary Examiner*—Steven B. Wong

*Attorney, Agent, or Firm*—Kolisch, Hartwell, Dickinson, McCormack & Heuser

[57] ABSTRACT

A game footbag includes a generally spherical outer skin formed of a pair of octagonal end caps oppositely positioned and joined by a plurality of longitudinal panels. Each longitudinal panel extends between aligned facets of the octagonal end caps and is mutually joined to the adjacent longitudinal panel on either side. In addition, each longitudinal panel is formed of a pair of complementary panel segments having complementary diagonal edges which are joined to form the longitudinal panel and which produce a plurality of angular sewn seams in the outer skin of the footbag. A filler comprised of generally oval or spheroid pellets having smooth outer surfaces loosely fill the interior of the spherical skin. In the preferred fabrication of the invention, the pellets forming the filler material are fabricated of a slick-surfaced plastic material such as Acetol.

12 Claims, 1 Drawing Sheet

GAME FOOTBAG HAVING IMPROVED SKIN AND FILLER

FIELD OF THE INVENTION

This invention relates generally to game ball articles and particularly to those known in the art as footbags characterized by low rebound properties.

BACKGROUND OF THE INVENTION

Game footbags have enjoyed growing popularity for many years and are utilized in a variety of recreational, amusement or sport activities. Basically, most game footbags are similar in overall fabrication and provide a flexible outer skin usually forming a generally spherical enclosure. A fill material or filler is provided often in the form of relatively hard, small pellet-like objects. In the fabrication of game footbags, the objective is to provide a loose fill of the filler pellets or other material sufficient to maintain a soft, easily deformed, generally spherical shape for the footbag. The objective is to provide a game article which is virtually free of elasticity or rebound characteristic. In addition there is a substantial need to provide a durable construction allowing the footbag to absorb substantial impact energy without damage.

In attempting to meet and satisfy the ever growing popularity of game footbags, practitioners in the art have endeavored to provide a wide variety of game footbag articles. For example, U.S. Pat. No. 5,566,953 issued to Arriola et al sets forth a GAME FOOTBAG WITH LOW REBOUND CHARACTERISTICS having a plurality of panels joined along their respective edges to define an impact deformable semi-collapsible chamber. The footbag includes at least one panel having a portion formed with an apertured material for providing a view into the chamber. A filler formed of a plurality of lightweight, impact damping filler members is disposed in the chamber.

U.S. Pat. No. 4,151,994 issued to Stalberger, Jr. sets forth a GAME FOOTBAG having a durable, flexible cover generally spherical in shape and partially filled with material having substantially fluid characteristics. The cover consists of two dogbone-shaped pieces of flexible material joined to form a collapsible ball.

U.S. Pat. No. 4,717,158 issued to Pennisi sets forth a GAME FOOTBAG having a spherical skin of soft, light-emitting plastic material having a plurality of air holes in its surface. The sphere is filled with fluid light-emitting particulate pellet filler material.

U.S. Pat. No. 4,943,066 issued to Lathim et al sets forth a BALL-LIKE ARTICLE having a flexible outer skin sized and shaped to be readily grasped within the palm of one hand. The skin has a plush outer surface and defines an interior approximately half filled with a quantity of plastic pellets or other granular material.

U.S. Pat. No. 4,963,117 issued to Gualdoni sets forth a SELECTIVELY ILLUMINATED TOY BALL having a generally spherical outer skin formed of a light transmissive material and filled with a plurality of translucent or fluorescent beads. An aperture is provided in the skin for inserting a chemical light stick.

U.S. Pat. No. 5,429,351 issued to Hanson sets forth a GAME APPARATUS forming a hand bag for striking by a player's hand which comprises first and second panels stitched about their periphery and containing fluid pellets of a high density polyethylene material.

Design Pat. No. 281,521 issued to Stalberger, Jr. et al and Design Pat. No. 292,014 also issued to Stalberger, Jr. et al set forth designs for footbags.

U.S. Pat. No. 4,354,679 issued to Steinmetz sets forth a GAME BAG of spherical construction having a pliable cover formed from pentagon-shaped cover members stitched together.

U.S. Pat. No. 3,937,470 issued to Stalberger, Jr. et al sets forth a GAME FOOTBAG having a tough flexible cover partially filled with predominantly parallel small disks to form a big disk or flattened sphere.

U.S. Pat. No. 5,328,191 issued to Taylor, Jr. sets forth a GAME PROJECTILE AND METHOD OF PLAYING A GAME UTILIZING A PROJECTILE having an energy dissipative core formed of ribbon-like filler material.

U.S. Pat. No. 4,011,611 issued to Lederman-sets forth an OUTDOOR BEAN BAG formed of a water resistant outer fabric.

U.S. Pat. No. 4,974,844 issued to Richards; U.S. Pat. No. 5,066,018 issued to Hinton; and U.S. Pat. No. 1,960,803issued to Baumer set forth various novelty ball items.

While the foregoing described prior art devices have, to some extent, improved the art, and have in some instances enjoyed commercial success, there remains nonetheless a continuing need in the art for evermore improved, durable and high performance game footbags.

SUMMARY OF THE INVENTION

Accordingly, it is a general object of the present invention to provide an improved game footbag. It is a more particular object of the present invention to provide an improved game footbag having a more durable outer skin and interior filler providing a more fluid action.

In accordance with the present invention, there is provided a game footbag having a low rebound characteristic, the game footbag comprising: a generally spherical flexible outer skin having a pair of multifaceted end caps oppositely positioned and a plurality of mutually joined longitudinal panels each having opposed ends joined to one of the facets on each of the end caps, each of the longitudinal panels being formed of a pair of complementary panel segments having convexly curved sides, a straight edge joining the facet of the end cap and an angled edge joined to the angled edge of its complementary panel segment; and a quantity of filler formed of a plurality generally rounded slick-surfaced pellets.

BRIEF DESCRIPTION OF THE DRAWINGS

The features of the present invention, which are believed to be novel, are set forth with particularity in the appended claims. The invention, together with further objects and advantages thereof, may best be understood by reference to the following description taken in conjunction with the accompanying drawings, and in which:

DESCRIPTION OF THE PREFERRED EMBODIMENT

Figure 1:
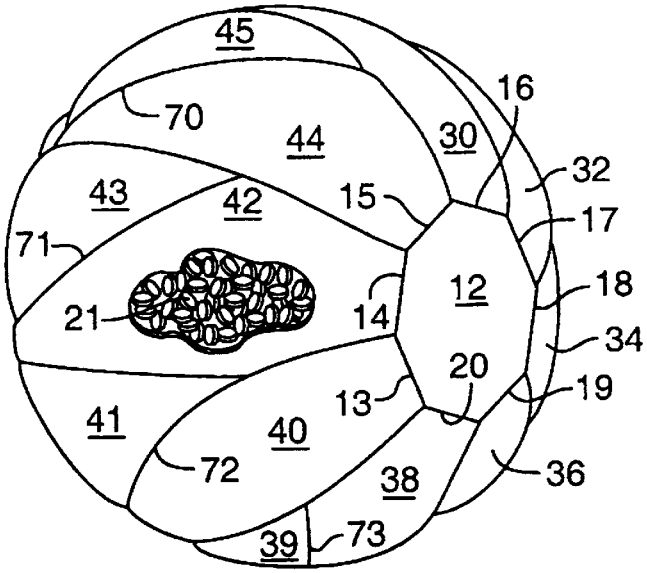
FIG. 1 sets forth a partially sectioned perspective view of a game footbag constructed in accordance with the present invention.

FIG. 1 sets forth a partially sectioned perspective view of a game footbag constructed in accordance with the present invention and generally referenced by numeral 10. Footbag 10 includes an outer skin generally referenced by numeral 11 and defining a substantially spherical shape. Footbag 10 is shown in partial section and is loosely filled with a pelletized filler 21. Filler 21 is formed of a plurality of rounded preferably smooth surfaced pellets forming a smooth flowing particulate material. In its preferred form, filler 21 is formed of smooth oval-shaped pellets fabricated of a Acetol plastic material to enhance performance. The important property of the Acetol is a slick surface characteristic which allows filler 21 to flow easily absorbing energy and providing virtually no rebound characteristic for footbag 10.

In its preferred fabrication, outer skin 11 is formed of a plurality of panels, each fabricated of a high quality synthetic suede for maximum durability and flexibility.

Figure 2:
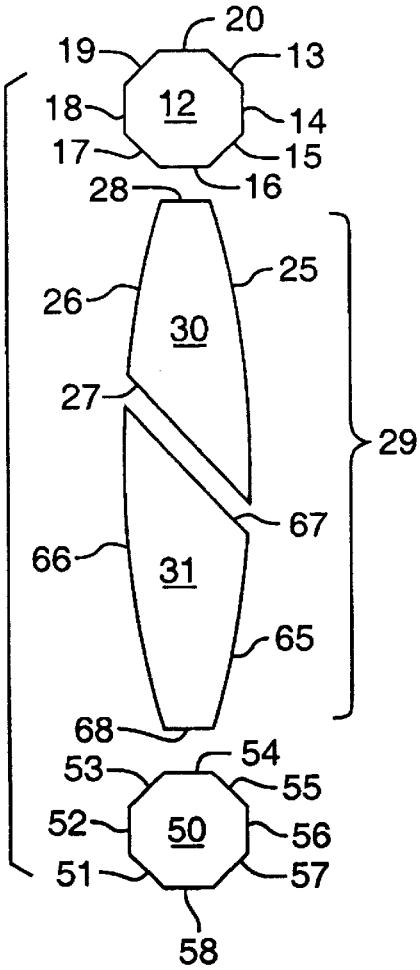
FIG. 2 sets out an exemplary arrangement of a panel set for the present invention game footbag.
Figure 3:
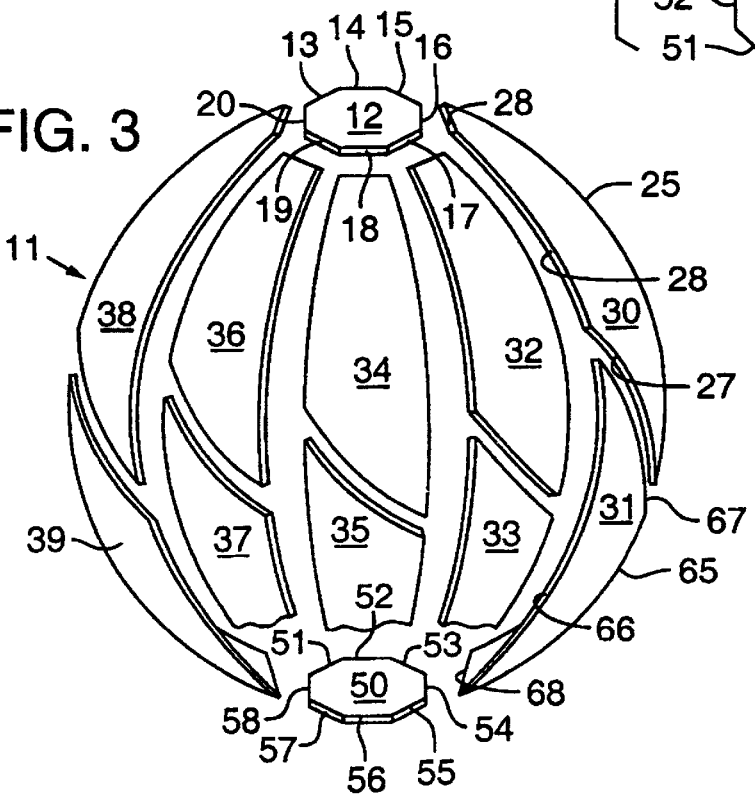
FIG. 3 sets forth a partially sectioned perspective view of the panels of the present invention game footbag forming a spherical outer skin.

Thus outer skin 11 is formed having a pair of octagonal end caps 12 and 50 (cap 50 seen in FIGS. 2 and 3). End caps 12 and 50 are positioned at opposite poles of generally spherical outer skin 11. End cap 12 defines a plurality of facet edges 13 through 20 to which a corresponding plurality of panel segments 30, 32, 34, 36, 38, 40, 42, and 44 are joined to end cap 12 at facets 16, 17, 18, 19, 20, 13, 14, and 15, respectively, of end cap 12. The attachment of panel segments to end cap 12 is accomplished utilizing a conventional sewing or stitching operation.

As is better seen with temporary reference to FIG. 3, end cap 50 defining a plurality of facet edges 51 through 58 is positioned oppositely from end cap 12 and is secured to a corresponding plurality of panel segments forming a structure identical to the combination of end cap 12 and panel segments 30, 32, 34, 36, 38, 40, 42, and 44.

Returning to FIG. 1, outer skin 11 is completed as the panel segments joined to end cap 12 are joined to each of the panel segments secured to end cap 50 (seen in FIG. 3). For example, panel segment 44 is joined to panel segment 45 along a diagonal seam 70. Similarly, panel segment 42 is joined to panel segment 43 along a seam line 71 while panel segment 40 is joined to panel segment 41 along a seam line 72. Finally, panel segment 38 is joined to panel segment 39 along a seam line 73. The remaining panel segments from each end cap are similarly joined along their respective diagonal seams to complete the spherical outer skin of footbag 10.

FIG. 2 sets forth a plan view layout of a pair of panel segments extending between end caps 12 and 50. It will be understood from reference to FIGS. 1 and 3 in conjunction with FIG. 2 that the combination of panel segments 30 and 31 extending between facets 16 and 54, respectively, of end caps 12 and 50 is illustrative of a repeated pattern which completes the spherical outer skin. Panel segments 30 and 31 in essence form a "longitudinal" panel extending between end caps 12 and 50. The illustrative panel combination provided by panel segments 30 and 31 is referred to as longitudinal panel 29. As will be apparent from examination of FIGS. 1 and 3, a total of eight longitudinal panel combinations each having complementary panel segments are provided in outer skin 11.

More specifically, end cap 12 defines an octagonal polar cap for outer skin 11 and thus defines facet edges 13 through 20. Similarly, end cap 50 forms an octagonal polar cap for outer skin 11 oppositely positioned from end cap 12. End cap 50 also defines a plurality of facet edges 51 through 58.

Longitudinal panel 29 includes panel segments 30 and 31 which are shaped to complement one another and form a longitudinal segment panel when joined which extends between end caps 12 and 50. Accordingly, panel segment 30 defines an edge 28 suitable for joining to facet edge 16 of end cap 12 together with a pair of longitudinal line curve edges 25 and 26. Finally, panel segment 30 defines a diagonal cut edge 27.

Panel segment 31 is complementary to panel segment 30 and thus defines an edge joined to facet edge 54 of end cap 50 together with a pair of longitudinally curved edges 65 and 66 and a diagonal cut edge 67. The provision of diagonal cut edges 27 and 67 of panel segments 30 and 31 provides a novel outer skin for the present invention game footbag. As panel segments 30 and 31 are joined by sewing edges 27 and 67 together, a novel diagonal seam which traverses the longitudinal panel (panel 29) thus formed provides a novel outer skin seam pattern.

FIG. 3 sets forth a perspective assembly view of outer skin 11 of game footbag 10. As described above, outer skin 11 utilizes a pair of oppositely positioned end caps 12 and 50 each defining an octagonal shape and each defining a corresponding plurality of facet edges. End cap 12 defines facet edges 13 through 20 while end cap 50 defines facet edges 51 through 58. End cap 12 and 50 are positioned on opposite sides of outer skin 11 and thus define "polar" end caps. A plurality of panel segments 30, 32, 34, 36, 38, 40, 42, and 44 (segments 40, 42, and 44 seen in FIG. 1) are joined at their respective upper edges to the facets of end cap 12 in a sewn attachment forming correspondingly shaped seams. Similarly, a plurality of panel segments 31, 33, 35, 37, 39, 41, 43, and 45 (segments 41, 43, and 45 seen in FIG. 1) are joined at their respective lower edges to corresponding facets of end cap 50 in sewn attachment forming correspondingly shaped sewn seams.

Each aligned pair of panel segments are joined along their respective diagonal edges to form a longitudinal panel in the manner illustrated for panel segments 30 and 31 joined along respective diagonal edges 27 and 67 to form longitudinal panel 29 in the manner shown in FIG. 2. Correspondingly, panels 32 and 33, panels 34 and 35, panels 36 and 37, panels 38 and 39, panels 40 and 41, panels 42 and 43, and panels 44 and 45 are joined to form longitudinal segments (panel segments 40 through 45 better seen in FIG. 1). Finally, the edges of each panel segment are joined to the panel segment on either side thereof in sewn attachment forming correspondingly shaped sewn seams to provide spherically-shaped outer skin 11 having the seam pattern illustrated in FIG. 1.

The resulting game footbag combines several advantageous features to provide an improved an novel game footbag. The use of diagonal seams joining respective panel segments to form longitudinal panels diagonally interrupted provides a novel and unusual physical appearance for the present invention game footbag. The combination of outer skin material comprising high quality synthetic suede together with a highly fluid action filler formed of slick-surfaced plastic pellets substantially improves the durability and performance of the present invention game footbag. In the preferred fabrication of the present invention, the filler pellets are fabricated in a generally oval or spheroid shape using a material known as Acetol. The resulting filler pellets slide easily upon each other and as a result increase the "liquid-like" behavior of the footbag filler. The smoother, more fluid sliding action of the filler pellets also enhances the energy absorption capability of the game footbag as the pellets within the filler material easily slide upon each other and displace each other when the footbag is impacted.

While particular embodiments of the invention have been shown and described, it will be obvious to those skilled in the art that changes and modifications may be made without departing from the invention in its broader aspects. Therefore, the aim in the appended claims is to cover all such changes and modifications as fall within the true spirit and scope of the invention.

That which is claimed is:

1. A game footbag having a low rebound characteristic, said game footbag comprising:

a generally spherical flexible outer skin having a pair of multifaceted end caps oppositely positioned and a plurality of mutually joined longitudinal panels each having opposed ends joined to one of said facets on each of said end caps, each of said longitudinal panels being formed of a pair of complementary panel segments having convexly curved sides, a straight edge joining said facet of said end cap and an angled edge joined to the angled edge of its complementary panel segment; and a quantity of filler formed of a plurality of generally rounded slick-surfaced pellets.

2. The game footbag set forth in claim 1 wherein said multifaceted end caps define regular polygons.

3. The game footbag set forth in claim 2 wherein said end caps are octagonal.

4. The game footbag set forth in claim 3 wherein said pellets are generally oval-shaped.

5. The game footbag set forth in claim 4 wherein said pellets are formed of Acetol material.

6. The game footbag set forth in claim 5 wherein said end caps and panel segments are formed of synthetic suede material.

7. The game footbag set forth in claim 1 wherein said pellets are formed of Acetol material.

8. The game footbag set forth in claim 1 wherein said end caps and panel segments are formed of synthetic suede material.

9. The game footbag set forth in claim 7 wherein said multifaceted end caps define regular polygons.

10. The game footbag set forth in claim 9 wherein said end caps are octagonal.

11. The game footbag set forth in claim 10 wherein said pellets are generally oval-shaped.

12. A game footbag comprising:

a generally spherical outer skin formed of a plurality of longitudinal panels each having curved sides and each defining a transverse diagonal seam and a pair of end caps, said longitudinal panels each joined along their respective adjacent sides and each joined to said pair of end caps; and a filler material loosely filling the interior of said outer skin having a plurality of generally oval pellets, each having a smooth slick outer surface whereby said pellets flow easily upon each other within said outer skin.

* * * * *